US006986284B2

(12) United States Patent
Muldowney

(10) Patent No.: US 6,986,284 B2
(45) Date of Patent: Jan. 17, 2006

(54) SYSTEM AND METHOD FOR CHARACTERIZING A TEXTURED SURFACE

(75) Inventor: Gregory P. Muldowney, Glen Mills, PA (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 10/652,173

(22) Filed: Aug. 29, 2003

(65) Prior Publication Data

US 2005/0044957 A1 Mar. 3, 2005

(51) Int. Cl.
*G01L 7/00* (2006.01)

(52) U.S. Cl. ..... 73/706; 451/5

(58) Field of Classification Search ..... 73/708, 73/706; 451/5, 8, 259, 286, 285, 287
See application file for complete search history.

(56) References Cited

U.S. PATENT DOCUMENTS 5,840,629 A * 11/1998 Carpio ..... 438/692
5,897,375 A * 4/1999 Watts et al. ..... 438/693
5,954,997 A * 9/1999 Kaufman et al. ..... 252/79.1
5,985,748 A * 11/1999 Watts et al. ..... 438/622
6,001,730 A * 12/1999 Farkas et al. ..... 438/627
6,063,306 A * 5/2000 Kaufman et al. ..... 252/79.4
6,238,590 B1 * 5/2001 Fischer et al. ..... 216/88
6,257,953 B1 * 7/2001 Gitis et al. ..... 451/5
6,283,829 B1 * 9/2001 Molnar ..... 451/8
6,413,153 B1 * 7/2002 Molar ..... 451/259
6,458,013 B1 * 10/2002 Saka et al. ..... 451/5
6,641,463 B1 * 11/2003 Molnar ..... 451/41
2004/0072522 A1 * 4/2004 Petroski et al. ..... 451/533
2004/0162688 A1 * 8/2004 Eaton et al. ..... 702/100
2004/0166779 A1 * 8/2004 Balijepalli et al. ..... 451/41
2004/0166790 A1 * 8/2004 Balijepalli et al. ..... 451/526
2004/0175941 A1 * 9/2004 Zhang et al. ..... 438/689

* cited by examiner

*Primary Examiner*—Edward Lefkowitz
*Assistant Examiner*—Andre Allen
(74) *Attorney, Agent, or Firm*—Blake T. Biederman

(57) ABSTRACT

A textured surface characterization system (100) includes a characterization apparatus (110) that contacts a textured surface (104) of an item (108) in order to characterize that surface. The characterization system includes a fluid delivery system (204) for flowing a fluid (128) across the textured surface when the textured surface is in contact with the characterization apparatus. Pressure measurement structures (144, 160) on the characterization apparatus provide pressure data for the fluid as it flows across the textured surface. This pressure data is used to characterize the textured surface.

10 Claims, 5 Drawing Sheets

Angular Pressure Drop Profiles

SYSTEM AND METHOD FOR CHARACTERIZING A TEXTURED SURFACE

BACKGROUND

The present invention relates to a system and method for characterizing a textured surface useful for assessing and/or characterizing textured surfaces of various items, e.g., polishing pads, in particular polishing pads used in chemical-mechanical planarization (CMP), for purposes such as production quality control and development of such items.

CMP polishing is a process currently practiced in the semiconductor and other industries for creating flat surfaces on integrated circuit wafers and magnetic storage disks, among other things. Generally, CMP involves flowing or otherwise placing a polishing slurry or fluid between the wafer, memory disk or other workpiece to be planarized and a CMP polishing pad, and moving the pad and workpiece relative to one another while biasing the pad and workpiece together. CMP polishing pads generally have a textured surface that allows slurry to move throughout the network of voids formed when the peaks and valleys of the textured surface are brought into contact with the surface of the workpiece. The textured surfaces of CMP polishing pads having various topographies adapted to different polishing scenarios are known in the art.

Surface flow resistance is a critical characteristic of CMP polishing pads that impacts flow patterns of the polishing slurry in the voids between the pad and workpiece during polishing. Liquid flow patterns affect the delivery of fresh slurry to the workpiece surface, the removal of polishing debris from the surface and the conveyance of heat from both chemical reaction and mechanical abrasion. More accurate optimization of CMP performance and more effective design of CMP polishing pads and slurries would be possible if the exact flow patterns in the voids could be predicted. However, the surface flow resistance of a CMP polishing pad is impossible to measure dynamically on a CMP machine because the spaces between the pad and workpiece are inaccessible to conventional measuring devices. In addition, CMP generally involves variously overlapping and concurrent physics due to the orbital action of CMP that make it virtually impossible to isolate from CMP data typically collected the effects of fluid flow pattern.

Research and modeling of CMP to date have applied fluid flow treatments adapted from bearing theory, which describes CMP pads in terms of roughness parameters or a distribution of surface peaks, aka "asperities." These conventional approaches generally suffer from three shortcomings: (1) the pad surface descriptors are not easily related to measurable physical quantities; (2) it is unclear how the pad surface descriptors change under conditions of compression, shear and wetting that prevail in the pad-wafer gap during CMP; and (3) the fluid motion description is oversimplified such that practical features of interest, such as grooves or perforations, are difficult to model.

STATEMENT OF THE INVENTION

The present invention differs from conventional CMP characterization approaches in at least three ways. First, the present invention provides an insightful method of isolating fluid flow from the other physics of a typical CMP process. Second, the present invention permits the determination of the behavior of a CMP polishing pad's textured surface under various conditions of compression, shear and wetting. Third, the present invention applies the fluid mechanics concept of "porous media flow" to the flow region formed in the space between the textured surface of a pad and a wafer when the pad is pressed against the wafer. With these differences, the present invention provides, among other things, new and versatile descriptors of the working surfaces of CMP pads and a method of determining these descriptors using fast and cost-effective testing.

In a first aspect, the present invention is directed to a method of characterizing a textured surface having a plurality of asperities, comprising the steps of: a) moving a confining surface and the textured surface into confronting relationship with one another so that at least some of the asperities of the textured surface contact the confining surface so as to define a flow region; b) causing a fluid to flow within the flow region so as to create pressure in fluid within the flow region; and c) measuring the pressure of the fluid at a plurality of locations in the flow region so as to obtain pressure data. In a second aspect, the present invention is directed to an apparatus for characterizing a textured surface having a plurality of asperities, comprising: a) a confining surface having an area and including a plurality of pressure measuring structures distributed over the area, the confining surface adapted for confronting the textured surface so as to define a flow region among the plurality of asperities; b) a fluid delivery system fluidly communicating with the flow region when the confining surface is confronting the textured surface so as to provide a fluid to the flow region such that the fluid is under pressure within the flow region; and c) a pressure measuring system operatively connected to each one of the plurality of pressure measuring structures and adapted to measure the pressure within the flow region proximate each one of the plurality of pressure measuring structures.

DETAILED DESCRIPTION OF THE INVENTION

Figure 1:
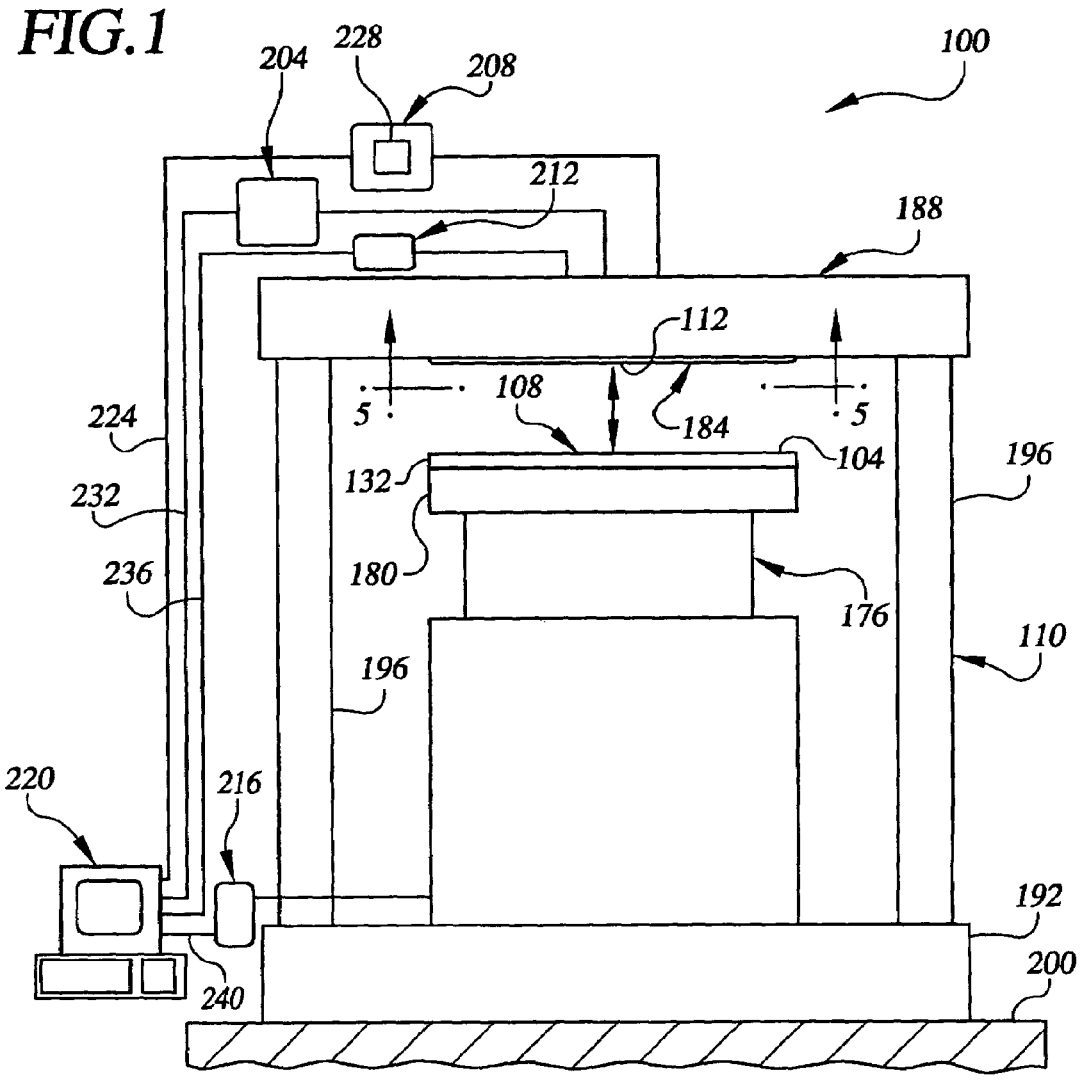
FIG. 1 is a partial high level schematic diagram/partial elevational view of a textured surface characterization system and apparatus according to the present invention.

Referring now to the drawings, FIG. 1 shows in accordance with the present invention a textured surface characterization system, which is generally denoted by the numeral 100. Characterization system 100 may be used for characterizing a textured surface 104 of an item 108, e.g., in order to assess various aspects of the textured surface.

Characterization system 100 may be particularly useful for characterizing textured surface 104 when this surface is designed to confront a confining surface (not shown) during normal use of item 108. As discussed above, an item 108 having such a textured surface that is critical to the proper functioning of the item is a polishing pad, in particular a polishing pad used for CMP. The quality and characteristics of the textured surface, i.e., working surface, of a CMP polishing pad are important because they relate to, among other things, the quality of a surface (not shown) planarized using the polishing pad, the polishing efficiency of the pad, the life of the pad and the operating parameters of the pad. Thus, a CMP polishing pad is a prime example of item 108 suitable for characterization using characterization system 100. Characterization system 100 may be used, e.g., as a quality control tool for assessing the quality of textured surface 104 when item 108 is a part of a production run or, alternatively, as a development tool for designing the textured surface, designing a process for making the textured surface and/or designing equipment for making the textured surface.

Figure 2:
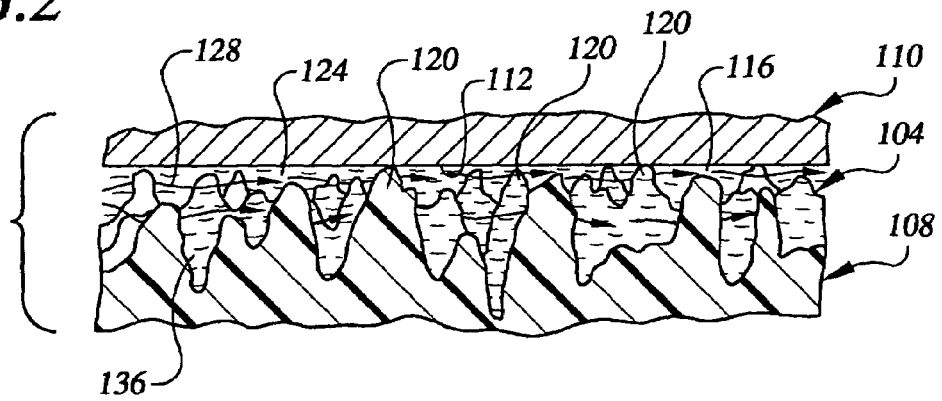
FIG. 2 is an enlarged cross-sectional view showing the confined spaced formed between the confining surface of the confinement apparatus of FIG. 1 and the textured surface of an item when the item is placed into contact with the confining surface.

Referring to FIGS. 1 and 2, characterization of textured surface 104 generally includes engaging item 108 with a characterization apparatus 110 of characterization system 100 and moving the item so that textured surface 104 contacts a confining surface 112 so as to create a substantially confined space 116 between the confining surface and the textured surface. Confined space 116 results from the asperities 120 (generally, the relatively high peaks of textured surface 104) contacting confining surface 112 and spacing the lower peaks and valleys away from the confining surface. Confined space 116 includes one or more flow regions 124 wherein fluid 128 can flow substantially parallel to confining surface 112 and out of confined space 116 at periphery 132 of item 108 (i.e., global flow) and one or more non-flow regions 136, typically the relatively deep valleys, wherein the fluid flow, if any, essentially remains local to the non-flow regions (i.e., local flow).

Figure 3:
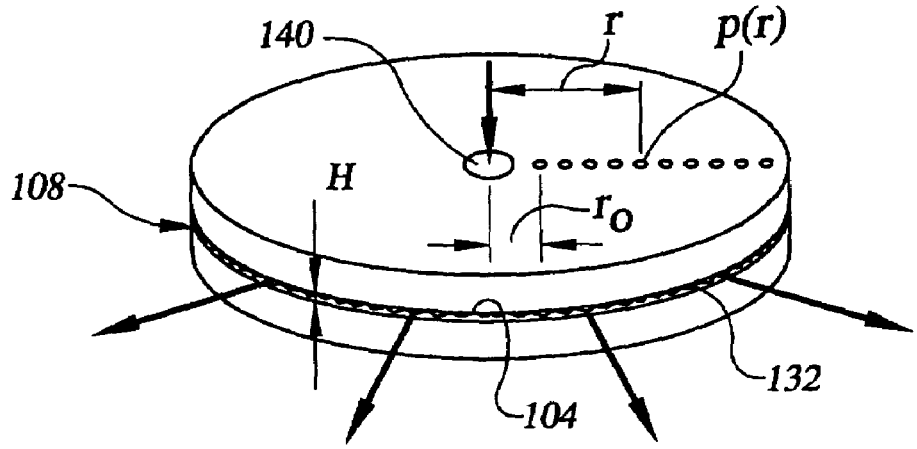
FIG. 3 is a schematic diagram illustrating the radial flow of fluid and the radial arrangement of pressure measurement structures during testing of a textured specimen in the apparatus of FIG. 1.

The flow of fluid 128 in flow region(s) 124 occurs in many interconnecting channels defined by confining surface 112 and textured surface 104. Thus, this flow may be characterized as porous media flow and analyzed using well-established theoretical fluid mechanics for porous media flow. Referring to FIG. 3, and occasionally to FIG. 2, FIG. 3 illustrates the testing of a circular item 108 wherein fluid 128 is introduced into confined space 116 at an inlet 140 located at the center of the item so that the flow of the fluid in flow region(s) 124 is substantially radial relative to the item 108. An advantage of this radial flow configuration is that the radial flow of fluid 128 requires consideration of flow conditions at only the parallel top and bottom boundaries used to confine the fluid, and not at any additional boundaries connecting the top and bottom. For example, if flow region 124 were rectangular and confined on opposing sides so as to induce a substantially linear flow from one end of the flow region to the other, the flow equations would be complicated by the boundary conditions at the confined sides. That said, however, it is noted that this linear flow scheme and other non-radial flow schemes are within the scope of the present invention, regardless of whether or not the resulting flow equations are more complex than the radial flow equations described herein.

In the radial flow model of FIG. 3, fluid 128 is introduced into confined space 116 at inlet 140 at a pressure $p_i$. As fluid 128 flows through flow region(s) 124 within confined space 116 from inlet 140 to periphery 132 of item 108, the pressure p in the fluid drops as a result of, among other things, frictional and momentum losses as the fluid flows across confining surface 112 (FIG. 2) and textured surface 104 and around asperities 120 globally in a substantially radial direction relative to item 108. As mentioned, these losses can be characterized using porous media flow theory. Accordingly, the pressure drop $\Delta p$ from an initial pressure $p_0$ at a radius $r_0$ to the pressure p(r) at any successively larger radius r may be approximated as:

$$p_0 - p(r) = \frac{w\mu}{(2\pi H)\rho g}\frac{\alpha(1-\varepsilon)^2}{D_E^2\varepsilon^3}\ln\frac{r}{r_0} + \frac{w^2}{(2\pi H)^2\rho g}\frac{\beta(1-\varepsilon)}{D_E\varepsilon^3}\left[\frac{1}{r_0} - \frac{1}{r}\right]$$

where: w is the mass flow rate;

$\alpha$ is a known constant;

$\beta$ is a known constant;

$\epsilon$ is the flowing void fraction of flow region 124;

$\mu$ is the viscosity of fluid 128;

$\rho$ is the density of the fluid;

g is the gravitational constant;

H is the effective channel height between confining surface 112 and textured surface 104; and $D_E$ is the characteristic length within the flow region, which is of the same order of magnitude as the mean asperity spacing.

As can be seen, the unknowns in the foregoing equation are the pressure drop $\Delta p$, the flowing void fraction $\epsilon$ and the characteristic length $D_E$ of flow region 124. The two latter unknowns are properties of textured surface 104 that have heretofore not been utilized in describing textured surfaces, but nonetheless may be helpful in characterizing these surfaces, e.g., in terms of attributes of the surfaces desirable for accomplishing the function(s) for which the surfaces are designed. Referring to FIG. 2, generally, the flowing void fraction $\epsilon$ characterizes the accessible flow volume within flow region(s) 124, and characteristic length $D_E$ characterizes the average spacing between asperities 120 of textured surface 104 and relates to the effective width of the passageways for fluid 128 within the flow region(s). In the context of polishing pads, including those used in CMP, these attributes include the ability of textured surface 104 to evenly distribute a slurry in the region between the pad and a semiconductor wafer or memory disk, conduct the slurry to the peripheral edge of the pad and to create a substantially uniform fluid pressure across all portions of the pad immediately confronting the wafer/disk. Some polishing pads include grooves or other structures that prevent portions of these pads from immediately confronting the wafer/disk; for these pads the flowing void fraction and characteristic length also control the relative amount of slurry conveyed in the grooved and ungrooved regions of the pad.

Figure 4:
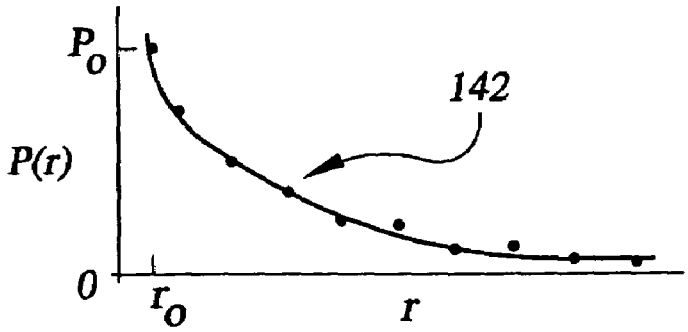
FIG. 4 is a plot of measured and computed pressures of the fluid in the flow region versus radius.

Referring again to FIG. 3, pressure drops $\Delta p$ at various radii r spaced from $r_0$ can be determined experimentally by measuring the pressure of fluid 128 at various locations along the flow path of the fluid from inlet 140 to periphery 132 of item 108. FIG. 4 illustrates a plot 142 of fluid pressures p(r) measured at the discrete radial locations (r) identified in FIG. 3. The measurement of these and other pressures are described in more detail below. Using these measured pressures, flowing void fraction $\epsilon$ and characteristic length $D_E$ can be determined using computational fluid dynamics matching of the radial profile of measured pressures at various mass flow rates w, fluid properties $\rho$ and $\mu$, and gap heights H.

Figure 5:
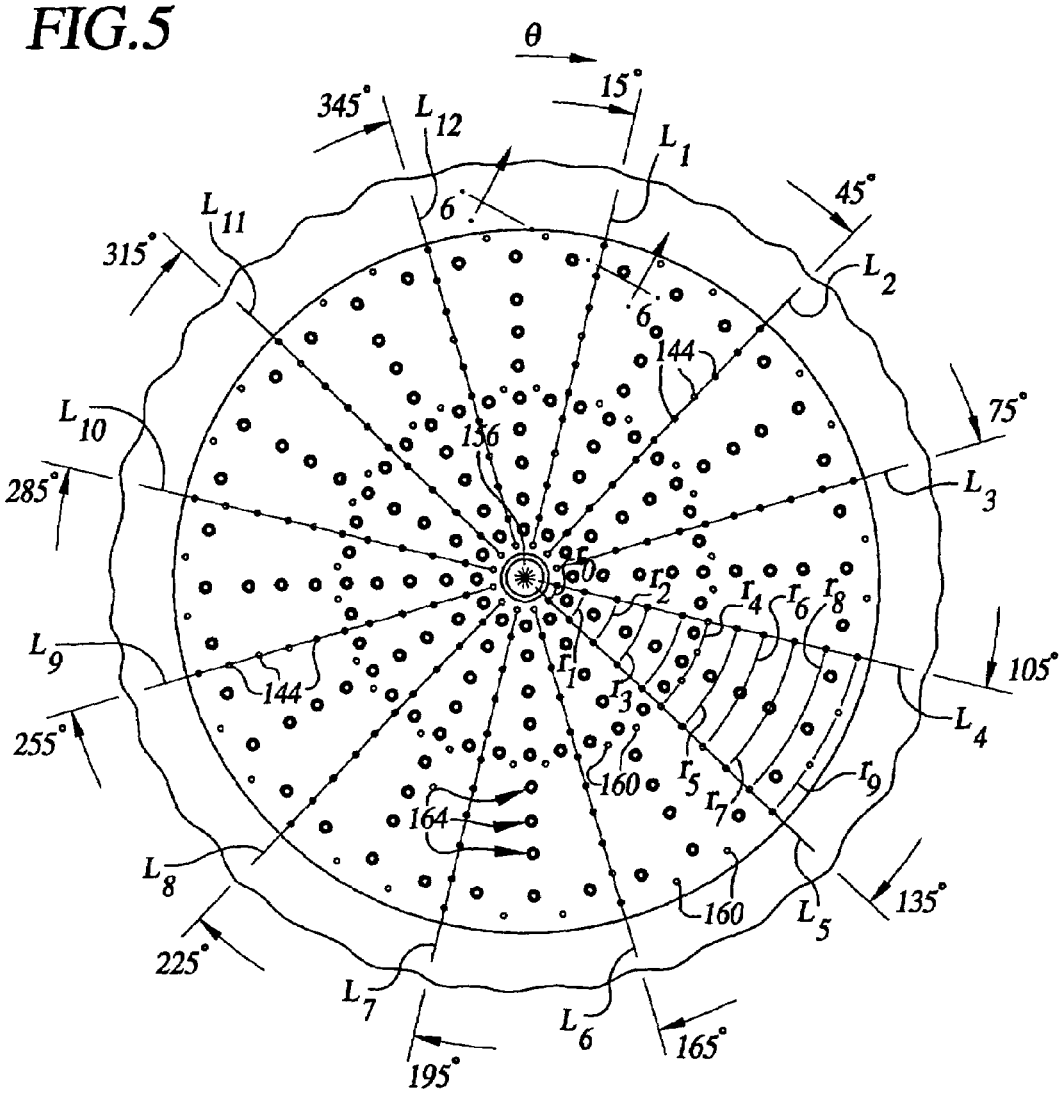
FIG. 5 is a cross-sectional view of the textured surface characterization apparatus as taken along line 5—5 of FIG. 1 showing the confining surface.
Figure 6:
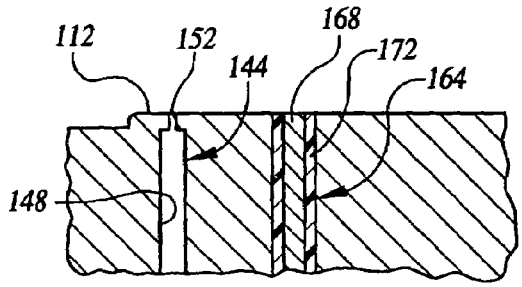
FIG. 6 is a cross-sectional view of the top of the textured surface characterization apparatus as taken along line 6—6 of FIG. 5.

The various pressures p(r) needed to determine pressure drops $\Delta p$ may be measured using characterization system 100 (FIG. 1) of the present invention. In this connection, characterization apparatus 110 may be configured for testing circular items 108 using the radial flow discussed above. For example, referring to FIGS. 1 and 5, and occasionally to FIG. 2, confining surface 112 of characterization apparatus 110 may include an array of pressure measurement structures 144, e.g., pressure sensors (not shown) or pressure taps fluidly communicating with pressure sensors, for measuring the pressure of fluid 128 in confined space 116 at various locations throughout the confined space. The pressure sensors may be any suitable type, such as mechanical or piezoelectric devices. FIG. 6 illustrates an embodiment wherein each pressure measurement structure 144 is a pressure tap comprising a cylindrical passageway 148 having a constriction 152 at the end proximate confining surface 112. In an embodiment suitable for characterizing polishing pads or samples thereof, the diameter of constriction 152 is about 0.031 inch (0.8 mm). Of course, the pressure tap may be configured and sized otherwise to suit a particular design.

Referring again to FIGS. 1 and 5, and occasionally to FIG. 2, in order to induce a radial flow of fluid 128 within flow region(s) 124, confining surface 112 may include an inlet 156 centrally located relative to the confining surface to provide fluid 128 to confined space 116 at its geometric center. Since the flow of fluid 128 is substantially radial when the fluid is in confined space 116 it is generally most convenient to arrange at least a portion of the pressure measurement structures 144 radially relative to inlet 156. In the embodiment shown in FIG. 5, pressure measurement structures 144 are primarily located along radial lines $L_1$–$L_{12}$ spaced 15° apart from immediately adjacent such radial lines. The pressure measurement structures 144 located along each of these radial lines $L_1$–$L_{12}$ are located at radii $r_0$–$r_9$. In the embodiment shown, the diameter of confining surface 112 is about 8 inches (200 mm) and radii $r_0$–$r_9$ have a regular spacing of about 0.4 inch (10 mm).

Additional pressure measurement structures 160 are located at radii $r_4$ and $r_9$ midway between adjacent the pressure measurement structures 144 located at these radii. Additional pressure measurement structures 160 are provided to allow additional data to be collected for more complete characterization of the behavior of the flow of fluid 128 in confined space 116 along circles of fixed radius. Again, the arrangement of pressure measurement structures 144, 160 shown in FIG. 5 is illustrative. Many other arrangements of structures 144, 160, including rectangular arrangements, are possible, though theoretical flow computations may be complicated by alternative arrangements.

Optionally, confining surface 112 may include an array of temperature measurement structures 164, e.g., thermocouples, for measuring the temperature of fluid 128 at various locations across the confining surface. Temperature data obtained using temperature measurement structures 164 may be used, e.g., to adjust fluid properties $\rho$ and $\mu$ to enhance the precision of the results of the computational fluid dynamics analysis, particularly where it is expected that relatively large temperature variations will occur as fluid 128 flows from inlet 156 to periphery 132 of item 108. During characterization of polishing pads, in particular those used for CMP, it is normally the case that any variation in temperature that occurs along the entire flow path of fluid 128 in flow region(s) 124 has a negligible impact on fluid properties and, therefore, need not be considered in the computation, although it can be. If the temperature variation along the flow path of fluid 128 is significant, it will improve the accuracy of the porous media flow equations if the fluid density and fluid viscosity are corrected for temperature changes. Similar to pressure measurement structures 144, 160, temperature measurement structures 164 may, but need not, be arranged in a substantially radial pattern relative to inlet 156. FIG. 6 shows one of temperature measurement structures 164 as comprising a thermocouple 168 surrounded by thermal insulation 172. Both thermocouple 168 and insulation 172 may be flush with confining surface 112 so as to not influence the flow of fluid 128 within confined space 116. Of course, other types and arrangements of temperature measurement structures 164 may be used.

Referring to FIGS. 1 and 2, as mentioned above, characterization of item 108 is typically performed with textured surface 104 in contact with confining surface 112 with a certain pressure applied between the item and the confining surface. During characterization, item 108 should be held substantially fixed relative to confining surface 112. To facilitate the proper positioning of item 108 relative to confining surface 112 and/or for precisely controlling the pressure applied between the item and confining surface, characterization apparatus 110 may include a positioning device 176, such as an elevator, having a movable platen 180 for supporting the item, moving the item into and out of contact with the confining surface and/or creating various contact pressures between the item and the confining surface. Device 176 may include any type of actuator, e.g., hydraulic, geared, screw type or pneumatic, among others, that provides the force and/or position control appropriate for the type of item 108 being characterized. Platen 180 should provide a rigid support for item 108. Accordingly, platen 180 may be made of any suitably stiff material, such as stainless steel. Of course, platen 180 may be made of another material, if desired. It is within the scope of the present invention that platen 180 may be freely rotating while remaining parallel to confining surface 112 and include a source of motive power and required mechanical linkages to provide such rotation. The latter may take the form of an internal drive system within the confines of positioning device 176 or a rim-driven system mounted externally to platen 180.

Confining surface 112 should likewise be substantially unyielding when subject to the pressures applied by item 108 and fluid 128. Accordingly, confining surface 112 may be defined by a confining region 184 of a relatively rigid stop 188. In the embodiment shown, stop 188 is machined from a relatively thick slab of stainless steel to provide confining surface 112 with its unyieldingness. In addition, confining surface 112 should be substantially smooth so as to not influence the characterization process in any unintended or negative way. In general, it is preferred that confining surface 112 have no surface variations having a height exceeding 1% of the height of the variations (i.e. texture) of the item being characterized. Thus, stop 188 is generally highly polished at confining surface 112. Like platen 180, other materials may be substituted for the stainless steel just mentioned, if desired. Moreover, those skilled in the art will recognize that stop 188 need not be a relatively thick monolith, but may be constructed otherwise, such as out of a thin plate and suitable reinforcing. Characterization apparatus 110 may include a relatively rigid base 192 supporting positioning device 176 and one or more ties 196 rigidly connecting stop 188 to the base. Base 192 may rest upon a work bench 200 or other suitable structure, or may be part of such structure.

Referring to FIG. 1, and also to FIGS. 2 and 3, several systems may be provided to support the functionality of characterization apparatus 110. These items may include a fluid delivery system 204, a pressure sensing system 208, a temperature sensing system 212, a positioning device control system 216 and one or more systems (not shown) for controlling, monitoring and collecting data from the other systems, among others. The systems for controlling, monitoring and collecting data from systems 204, 208, 212, 216 may be implemented on a computer 220, such as a general purpose computer, e.g., personal computer, or a computer configured especially for characterization system 100.

Characterization of textured surface 104 may be performed using any suitable fluid 128, e.g., liquid or gas. Accordingly, fluid delivery system 204 may be any type of system for delivering fluid 128 to confined space 116 under a pressure and at a flow rate desired for the particular type of item 108 under characterization and the configuration of characterization apparatus 110. Some exemplary pressures for characterization wherein fluid 128 is air are discussed below in connection with characterization performed on various samples, including samples of CMP polishing pads. Flow rates for these samples were generally on the order of 0.1–100 standard liters per minute. Those skilled in the art will readily understand how to design and implement a suitable fluid delivery system 204 such that a detailed explanation is not necessary herein. Fluid delivery system 204 may be in electrical communication with computer 220 via one or more appropriate communication links 224, e.g., one two-way link or two one-way links, which may include A/D (analog to digital), D/A (digital to analog) and other signal converters or other interfaces, depending upon the type actuators and transducers (not shown) the fluid control system utilizes.

Pressure sensing system 208 may include a plurality of pressure sensors/transducers (the plurality represented by box 228) each in fluid communication with a corresponding one of the pressure taps, i.e., pressure measurement structures 144, 160, for measuring the pressure in fluid 128 at that tap. Alternatively, as mentioned above, each pressure sensor/transducer may be one of pressure measurement structure 144, 160 itself. Each pressure sensor/transducer may be in electrical communication with computer 220 via an appropriate communication link 232, which may include an A/D converter, other signal converter or other interface (not shown), depending upon the type of pressure sensors/transducers utilized.

If temperature measurement structures 164 are provided, temperature sensing system 212 may similarly include the plurality of temperature measurement structures, e.g., thermocouples, each for measuring the temperature of fluid 128 at that temperature measurement structure. Each thermocouple may be in electrical communication with computer 220 via an appropriate communication link 236, which may include an A/D converter, other signal converter or other interface (not shown), depending upon the type of thermocouple utilized.

Positioning device control system 216 controls the operation of positioning device 176. Control system 216 and positioning device 176 may be operatively configured to control the movement of platen 180 based on the position of textured surface 104 relative to confining surface 112 and the pressure applied between the textured surface and confining surface. Thus, like fluid delivery system 204, positioning device control system 216 may be in electrical communication with computer 220 via one or more appropriate communication links 240, e.g., one two-way link or two one-way links, which may include A/D, D/A and other signal converters or other interfaces (not shown), depending upon the type actuator and transducers (not shown) positioning device 176 utilized.

Although characterization system 100 has been described as having a centralized control scheme, those skilled in the art will appreciate that the various systems needed to make characterization apparatus 110 operational may be controlled using a distributed control scheme. In addition, although characterization apparatus 110 has been described as having a particular configuration, those skilled in the art will appreciate that it may be configured differently. For example, confining surface 112 is shown as being configured for item 108 having a globally flat textured surface 104. However, confining surface 112 may be configured for a textured surface 104 having another contour, such as for example a domed or conical shape, or an entirely asymmetric form. Similarly, platen 180 may be contoured as needed to suit a particular configuration of item 108. Numerous other changes are possible, including, switching the locations of stop 188 and platen 180 and such that the platen is fixed and the stop is movable, among others.

EXAMPLES

Example 1

Figure 7A:
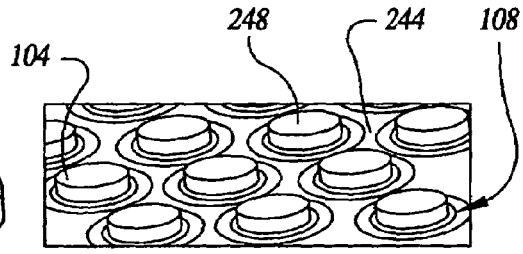
FIG. 7A is a perspective view of an "ideal" textured sample used to generate the plots of FIGS. 7B and 7C.

Referring to FIG. 7A, and also to FIGS. 1 and 2, FIG. 7A illustrates a textured surface 104 of an item 108 having a highly regular texture that provides the item with highly-regular flow regions 124 when the textured surface is in contact with confining surface 112 of characterization apparatus 110 of FIG. 1. Textured surface 104 is an example of an "ideal" (i.e. homogeneous) surface that, when characterized using characterization system 100, should display substantially radially uniform and axi-symmetric fluid pressure drop profiles due to the highly regular texture. Textured surface 104 includes a mounting surface 244 and a plurality of structures 248 (asperities) integrally formed atop the mounting surface. Each structure 248 is generally a cylindrical mesa having a radius of about 75 microns and a height above mounting surface 244 of about 50 microns. The plurality of structures 248 are arranged in a regular array. (Such material is marketed by 3M Inc., St. Paul, Minn., under the trade name SlurryFree™ Fixed Abrasive). When structures 248 are placed into contact with circular confining surface 112, flow region 124 spans the height between confining surface 112 and mounting surface 244 originating at inlet 156, e.g., radial lines $L_1$–$L_{12}$ (FIG. 5) and at radii $r_0$–$r_9$ that are concentric with the fluid inlet.

Figure 7B:
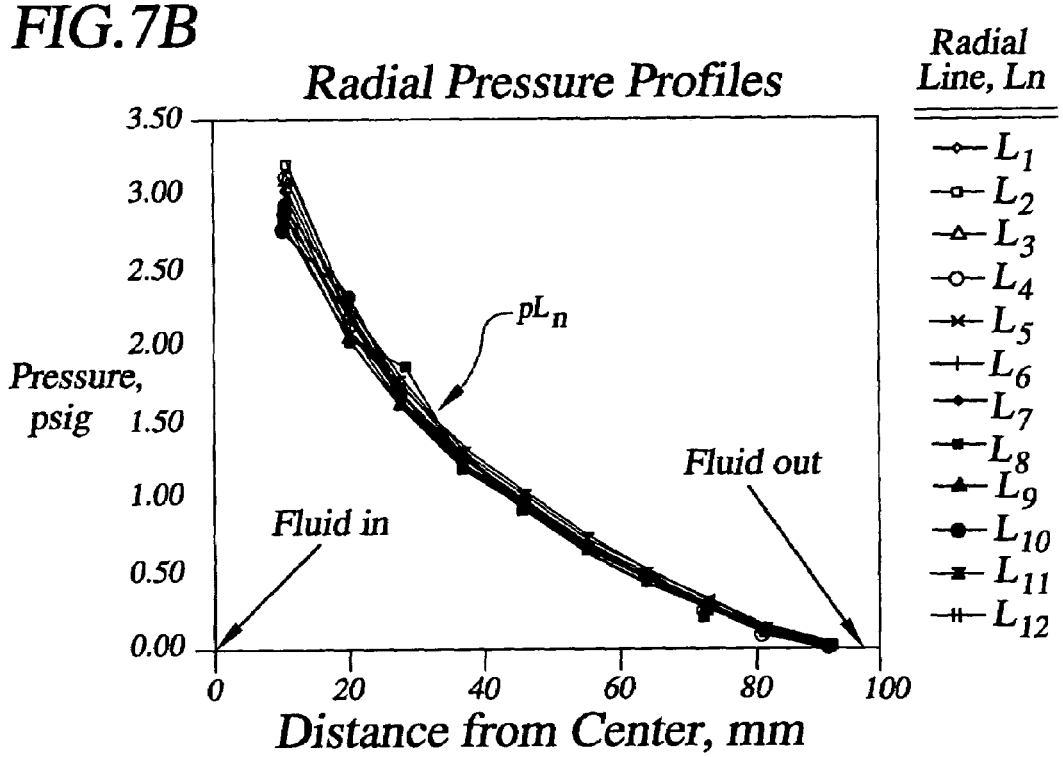
FIG. 7B is a plot of radial pressure profiles of the fluid in the fluid flow region along radial lines $L_1$ through $L_{12}$ for the ideal textured sample of FIG. 7A.
Figure 7C:
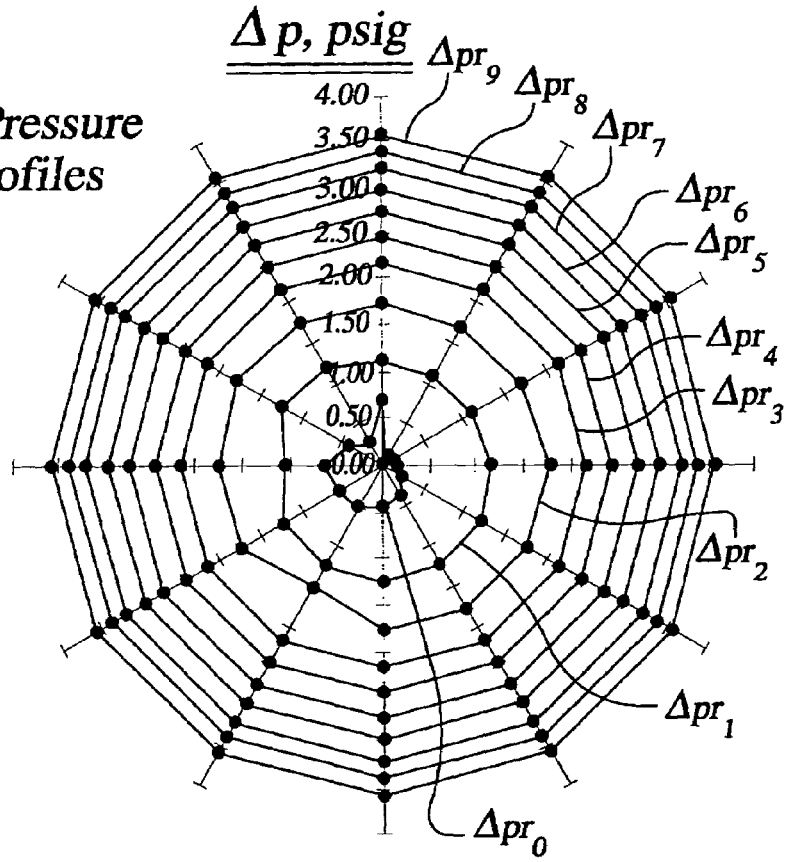
FIG. 7C is a plot of angular pressure drop profiles at radii $r_0$ through $r_9$ for the ideal textured sample of FIG. 7A.

Referring to FIG. 7B, and also to FIGS. 2 and 5, FIG. 7B shows radial pressure profiles $pL_n$ (n=1–12) of fluid 128, in this case air, present within confined space 116 between item 108 of FIG. 7A and confining surface 112 along radial lines $L_1$–$L_{12}$ (FIG. 5) when the fluid is injected into the confined space at a pressure of 4 psig. As can be readily seen, radial pressure profiles $pL_n$ are nearly identical to one another. Similarly, as shown in FIG. 7C, angular pressure drop profiles $\Delta pr_n$ (n=0–9) at radii $r_0$–$r_9$, respectively, are relatively uniform, except for several irregularities, particularly at $r_0$ where fluid 128 is locally disturbed due to the change in direction the fluid experiences proximate inlet 156 and, perhaps, due to several of structures 248 proximate the fluid inlet not being located symmetrically relative to the inlet. All in all, however, the pressure and pressure drop profiles $pL_n$, $\Delta pr_n$ of FIGS. 7B and 7C, respectively, are highly uniform, as expected for item 108 having an "ideal" textured surface.

Example 2

Figure 8A:
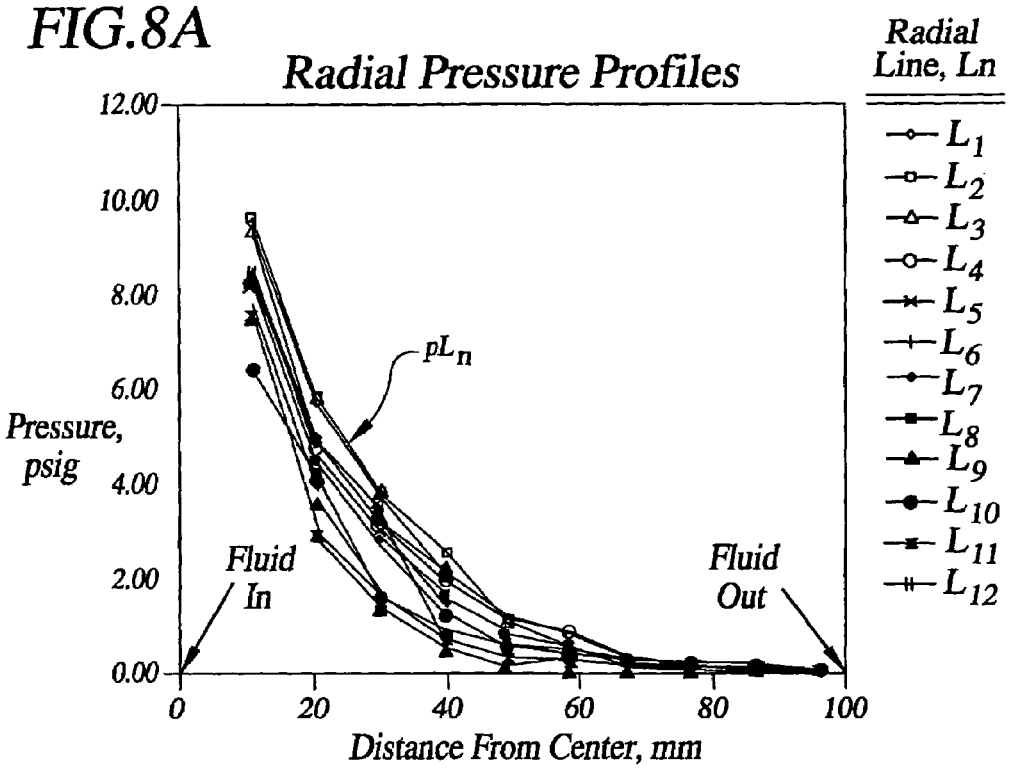
FIG. 8A is a plot of radial pressure profiles of the fluid in the fluid flow region along radial lines $L_1$ through $L_{12}$ for a textured sample having a variation in thickness.
Figure 8B:
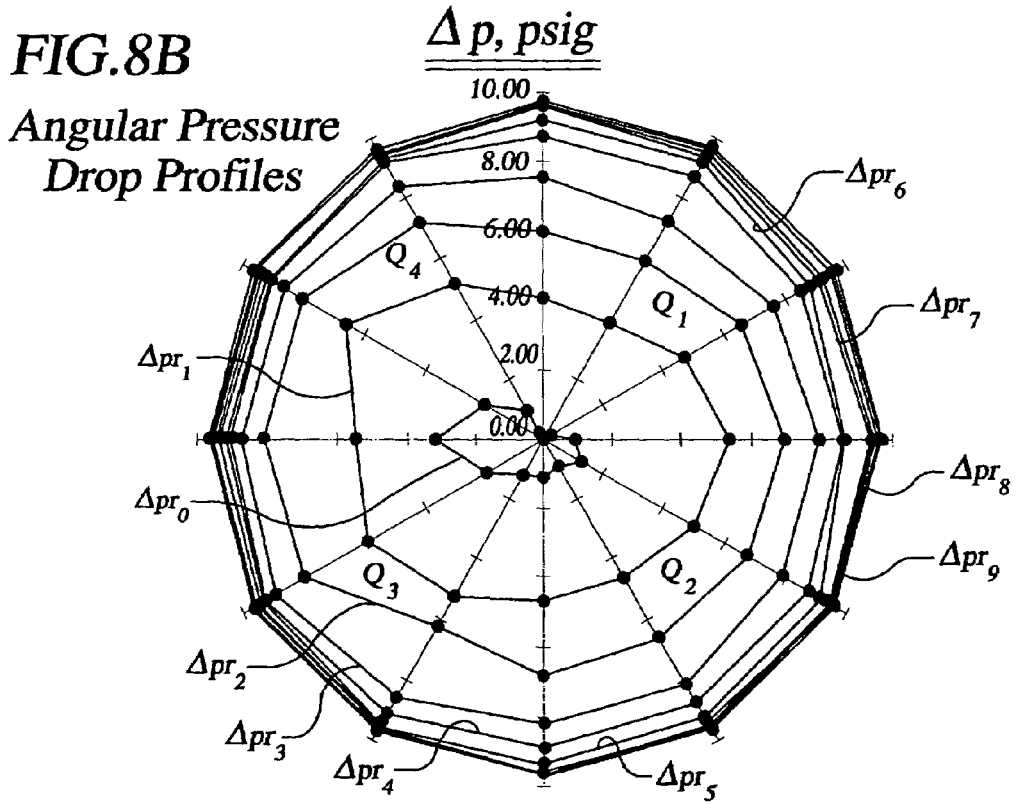
FIG. 8B is a plot of angular pressure drop profiles at radii $r_0$ through $r_9$ for the same sample.

FIGS. 8A and 8B show, respectively, radial pressure profiles $pL_n'$ (n=1–12) and angular pressure drop profiles $\Delta pr_n'$ (n=0–9) wherein item 108 (FIG. 1) is a sample of a microporous-polyurethane polishing pad. Generally, the polishing pad is made of polyurethane and includes a textured surface 104 consisting of asperities of random size and spacing. Although this sample has a uniform texture along radial lines $L_1$–$L_{12}$ (FIG. 5) and relative to radii $r_0$ –$r_9$, the sample has a non-uniform thickness over the area of confining surface 112 (FIG. 5). Since the upper surface of platen 180 (FIG. 1) is held parallel to confining surface 112 by the stiffness of the platen and positioning device 176 relative to stop 188, the non-uniform thickness causes asperities 120 (FIG. 2) in the thicker region(s) to be compressed and thereby distorted more than the asperities in the thinner region(s). Thus, although the spaces between asperities 120 (FIG. 2) when the sample is not compressed are generally uniform across the sample, when some of the asperities are compressed more than others, these spaces become non-uniform, resulting in flow region 124 in the region(s) of greater compression being more flow-constrictive than the flow regions in the region(s) of less compression. greater compression being more flow-constrictive than the flow regions in the region(s) of less compression.

As can be expected, the constricted flow in the region(s) of greater compression cause a larger pressure drop in fluid 128. This is readily seen in FIG. 8B in the central region of the sample, particularly at radii $r_0$, $r_1$ and $r_2$ (FIG. 5), where the pressure drop is relatively large. The magnitudes of pressure drops at corresponding angular pressure drop profiles $\Delta pr_0'$, $\Delta pr_1'$ and $\Delta pr_2'$ can be especially appreciated when compared to the angular pressure profiles $\Delta pr_n$ of FIG. 7C of the "ideal" item 108 of FIG. 7A, resulting from the same fluid and inlet pressure used in Example 2.Generally, pressure drop profile $\Delta pr_n'$ of FIG. 8A indicates that the tested sample is thicker in its central region than in its peripheral region. In addition, due to the relatively high concentricity of pressure drops $\Delta pr_0'$–$\Delta pr_9'$, it can be seen that the thicker region of the sample is generally concentric with confining surface 112 (FIG. 5), with some skew in quadrants $Q_3$ and $Q_4$.

Radial pressure profiles as shown in Examples 1 and 2 may be used along with the equations for flow in porous media to determine the void fraction and characteristic length that best describe the textured surface under consideration. The method of the present invention may be conducted at various degrees of compression to establish how the physical properties of void fraction and characteristic length vary under applied load, which can in turn be used to assess fluid flow distribution in a polishing process, in particular a CMP process, wherein the downward force on the workpiece varies from point to point. Further, the method of the present invention may be conducted at various degrees of rotation of the platen relative to the confining surface, while maintaining the platen parallel to the confining surface, to establish how the physical properties of void fraction and characteristic length vary under shear conditions, which can in turn be used to assess fluid flow distribution in a polishing process, in particular a CMP process, wherein the relative velocity between the polishing pad and the workpiece varies from point to point.

The method of the present invention may be applied to textured surfaces consisting of multiple layers, in particular polishing pads mounted on sub-pads that provide increased conformability to a workpiece. The method of the present invention may also be applied to textured surfaces containing large grooves, perforations, or voids in the surface, in particular polishing pads having one or more grooves to permit flow of a liquid across the surface.

The void fraction and characteristic length obtained by the method of the present invention may be compared between pads having subpads and/or grooves and pads without subpads and/or grooves to establish the impact of the subpad and/or grooves on the conformability of the pad surface to a workpiece, which can in turn be used to assess fluid flow distribution in a polishing process, in particular a CMP process, wherein the topography of a workpiece varies from point to point.

The method of the present invention may be applied to textured surfaces that have been subjected to various degrees of conditioning or roughening, in particular polishing pads conditioned with diamond conditioners to create a uniformly roughened surface. The void fraction and characteristic length obtained by the method of the present invention may be compared among polishing pads subjected to mild conditioning (short conditioning times and/or low conditioning force) and polishing pads subjected to harsh conditioning (long conditioning times and/or high conditioning force) to establish the impact of conditioning on the fluid flow distribution in a polishing process, in particular a CMP process.

What is claimed is:

1. A method of characterizing a textured surface having a plurality of asperities, comprising the steps of:

a) moving a confining surface and the textured surface into confronting relationship with one another so that at least some of the asperities of the textured surface contact the confining surface so as to define a flow region;

b) causing a fluid to flow within the flow region so as to create pressure in the fluid within the flow region;

c) measuring the pressure of the fluid at a plurality of locations in the flow region with an apparatus so as to obtain pressure data; and d) solving a fluid flow equation using at least some of the pressure data to determine physical quantities that characterize the textured surface.

2. The method according to claim 1, further wherein the step of solving the fluid flow equation uses a porous media fluid flow equation.

3. The method according to claim 1, wherein the textured surface is a working surface of a CMP polishing pad.

4. The method according to claim 1, wherein steps b and c are performed at a plurality of times at different contact pressures between the confining surface and the textured surface.

5. The method according to claim 1, wherein steps b and c are performed at a plurality of times at different degrees of shear between the confining surface and the textured surface.

6. An apparatus for characterizing a textured surface having a plurality of asperities, comprising:

a) a confining surface having an area and including a plurality of pressure measuring structures distributed over the area, the confining surface adapted for confronting the texture surface so as to define a flow region among the plurality of asperities;

b) a fluid delivery system fluidly communicating with the flow region when the confining surface is confronting the textured surface so as to provide a fluid to the flow region such that the fluid is under pressure within the flow region; and c) a pressure measuring system operatively connected to each one of the plurality of pressure measuring structures and adapted to measure the pressure within the flow region proximate each one of the plurality of pressure measuring structures.

7. The apparatus according to claim 6, further comprising a positioning device having a platen movable toward and away from the confining surface for positioning the textured surface relative to the confining surface.

8. The apparatus according to claim 7, further comprising a platen rotatable or translatable with respect to the confining surface for creating shear between the textured surface and the confining surface.

9. The apparatus according to claim 6, wherein the area of the confining surface has a geometric center and the fluid delivery system has a fluid inlet located at the geometric center.

10. The apparatus according to claim 6, wherein the confining surface further comprises:

d) a plurality of temperature measuring structures distributed over the area; and e) a temperature measuring system operatively connected to each one of the plurality of temperature measuring structures and adapted to measure the temperature within the flow region proximate each one of the plurality of temperature measuring structures.

* * * * *